United States Patent [19]

Moist, Jr.

[11] 4,443,048

[45] Apr. 17, 1984

[54] ASSEMBLY WITH VERIFICATION FEATURE

[75] Inventor: Stanford C. Moist, Jr., Hummelstown, Pa.

[73] Assignee: AMP Incorporated, Harrisburg, Pa.

[21] Appl. No.: 307,997

[22] Filed: Oct. 2, 1981

[51] Int. Cl.[3] ..... H01R 11/00

[52] U.S. Cl. ..... 339/63 M; 339/206 R; 339/217 S

[58] Field of Search ..... 339/217 S, 206 R, 206 P, 339/103 R, 63 R, 63 M

[56] References Cited

U.S. PATENT DOCUMENTS

| | | | |
|---|---|---|---|
| 3,165,369 | 1/1965 | Matson | 339/59 M |
| 3,478,305 | 11/1969 | Chirumbolo | 339/217 S |
| 3,560,910 | 2/1971 | Sosunski | 339/217 S |
| 3,667,101 | 6/1972 | Kloth | 29/203 HC |
| 3,769,701 | 11/1973 | Kloth | 29/867 |
| 3,835,442 | 9/1974 | Anderson et al. | 339/217 S |

FOREIGN PATENT DOCUMENTS

| | | |
|---|---|---|
| 1790043 | 12/1971 | Fed. Rep. of Germany . |
| 1428705 | 1/1966 | France . |

*Primary Examiner*—John McQuade
*Assistant Examiner*—Paula Austin
*Attorney, Agent, or Firm*—Gerald K. Kita; F. Brice Faller

[57] ABSTRACT

A kit of parts for an electrical connector assembly comprising, a composite housing for containing subassemblies comprising electrical contacts connected electrically to elongated conductors, and a retainer for mounting on the housing and for frictionally engaging the subassemblies during removal of the retainer from the housing so that as the lid moves along the subassemblies which are secured to the housing, the retainer withdraws from the housing any subassembly which is unsecured to the housing.

9 Claims, 4 Drawing Figures

ASSEMBLY WITH VERIFICATION FEATURE

This invention relates to an electrical connector assembly and a kit of parts therefor.

An electrical connector assembly is disclosed in U.S. Pat. No. 3,769,701 in which connector housings are back-to-back with their cavities in alignment. Subassemblies, consisting of electrical contacts connected to elongated conductors, are inserted and passed through the cavities. Then the housings are separated from each other and moved along the conductors until the contacts are lodged in the cavities.

In the present invention a kit of parts for a connector assembly comprises a connector housing having cavities for mounting subassemblies, consisting of electrical contacts connected electrically to elongated conductors, and a retainer for mounting on the housing, and for removal from the housing and passage along the subassembies, while a means on the retainer frictionally engages the subassemblies. Any subassembly which is unsecured in the housing will be withdrawn from the housing during removal of the retainer. The retainer thereby is useful to withdraw fom the housing any subassembly which because of damage or improper assembly is improperly lodged in the housing. The retainer alternatively is utilized for withdrawing a subassembly having a contact purposely designed for withdrawal by removal of the retainer.

Accordng to this invention, there is provided a kit of parts for an electrical connector assembly, adapted for mated connection with another, complementary connector assembly, and comprising: a housing having a rearward end and a forward end constructed for mated connection with a complementary housing of another connecter assembly; a retainer adapted for mounting on the rearward end of the housing; a plurality of passageways extending through said retainer; means on said retainer for frictionally engaging a subassembly, comprised of an elongated electrical conductor connected with an electrical contact, and projecting along a respective said passageway of said retainer; said housing having a plurality of cavities extending from said rearward end to said forward end; each of said cavities being adapted for receiving therein a respective said contact of a respective said subassembly; said retainer being removable from said housing in a rearward direction while frictionally engaged with each said subassembly, withdrawing from said housing any said subassembly that is unsecured within a respective said cavity of said housing.

Further, according to this invention, an electrical connector assembly comprises a housing having a rearward end and a forward end constructed for mated connection with a complementary housing of another connector assembly, a subassembly in each cavity is comprised of an elongated electrical conductor connected with an electrical contact, the conductor of each subassembly projects outwardly of the rearward end of the housing, characterised in that; a retainer is mounted removably on the rearward end of the housing, a plurality of passageways extend through the retainer, the conductors pass through respective passageways, means on the retainer frictionally engage the conductors, and the retainers is removable from the housing in a rearward directon to withdraw from the housing any subassembly, frictionally engaged by the means and, unsecured for retention in a respectve cavity of the housing.

An object of the present invention is to provide an electrical connector assembly comprising a composite housing into which are assembled subassemblies of elongated conductors connected to electrical contacts, and a rearward portion of the housing is removable from the other forward portion to withdraw those subassemblies which are either mistakenly or purposely unsecured to the forward portion.

An object of the present invention is to provide a kit of parts for an electrical connector assembly in which a lid is adapted for mounting to a connector housing and for removal therefrom while frictionally engaging subassemblies comprised of electrical conductors connected to electrical contacts, the lid frictionally moving along subassemblies secured in the housing and withdrawing those subassemblies which are either mistakenly or purposely unsecured to the housing.

Other objects and advantages will be apparent, and the invention understood by way of example from the following description taken in conjunction with the drawings.

Figures 1, 2:
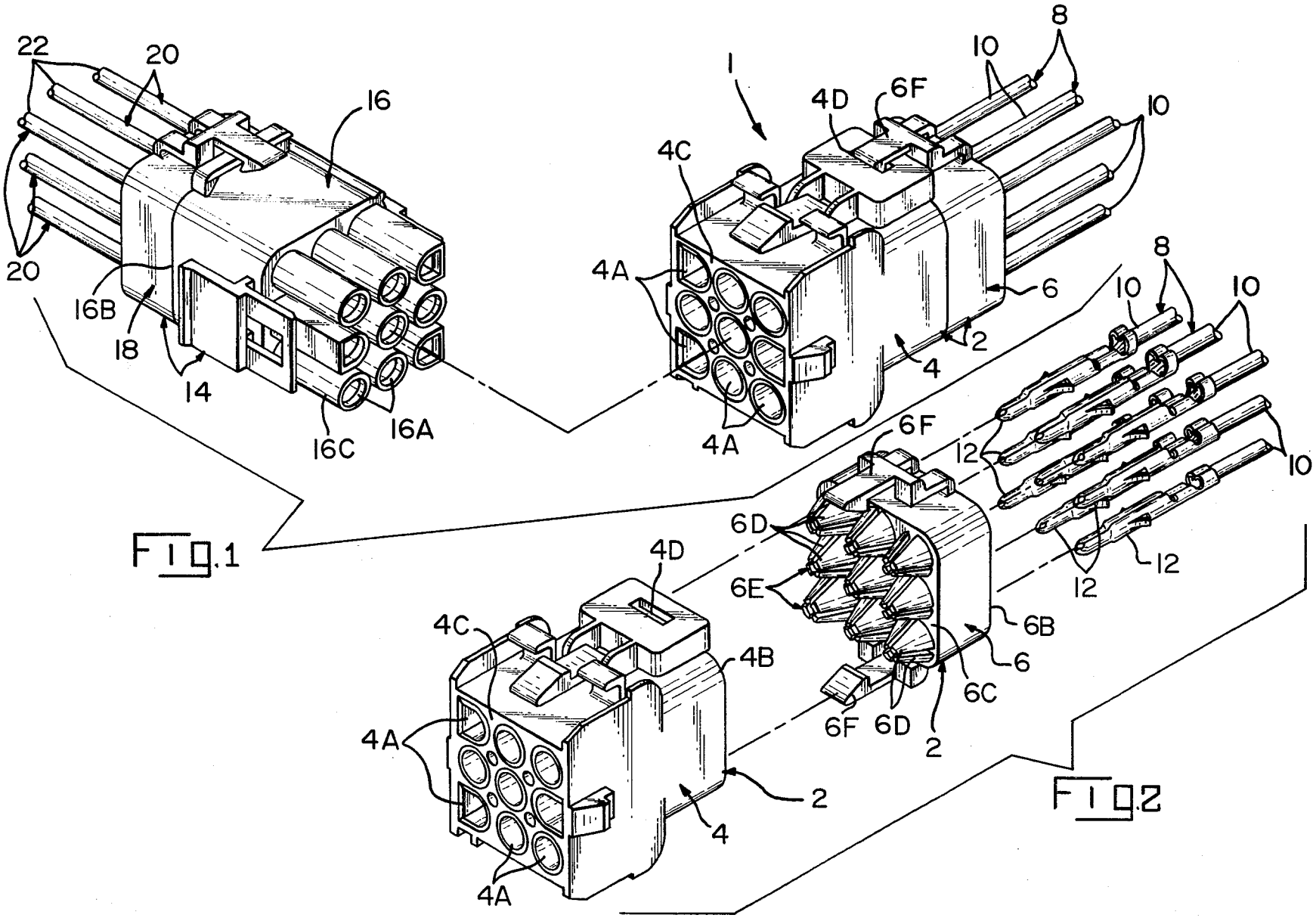
FIG. 1 is a fragmentary perspective view of a pair of connector assemblies intermateable with each other, and either of which comprises an embodiment of the present invention.
FIG. 2 is a fragmentary perspective view of one of the assemblies with parts thereof in exploded configuration for illustration purposes.

With reference to FIGS. 1 and 2, a connector assembly 1 comprises a composite housing 2 comprising a portion 4 and a retainer 6 separable from the portion 4. The housing 2 is adapted for assembly with a plurality of subassemblies 8. Each subassembly 8 comprises an insulated electrical conductor 10, the conductive portion of which is electrically and mechanically joined to an electrical contact 12 shown in the form of an electrical pin.

Figure 3:
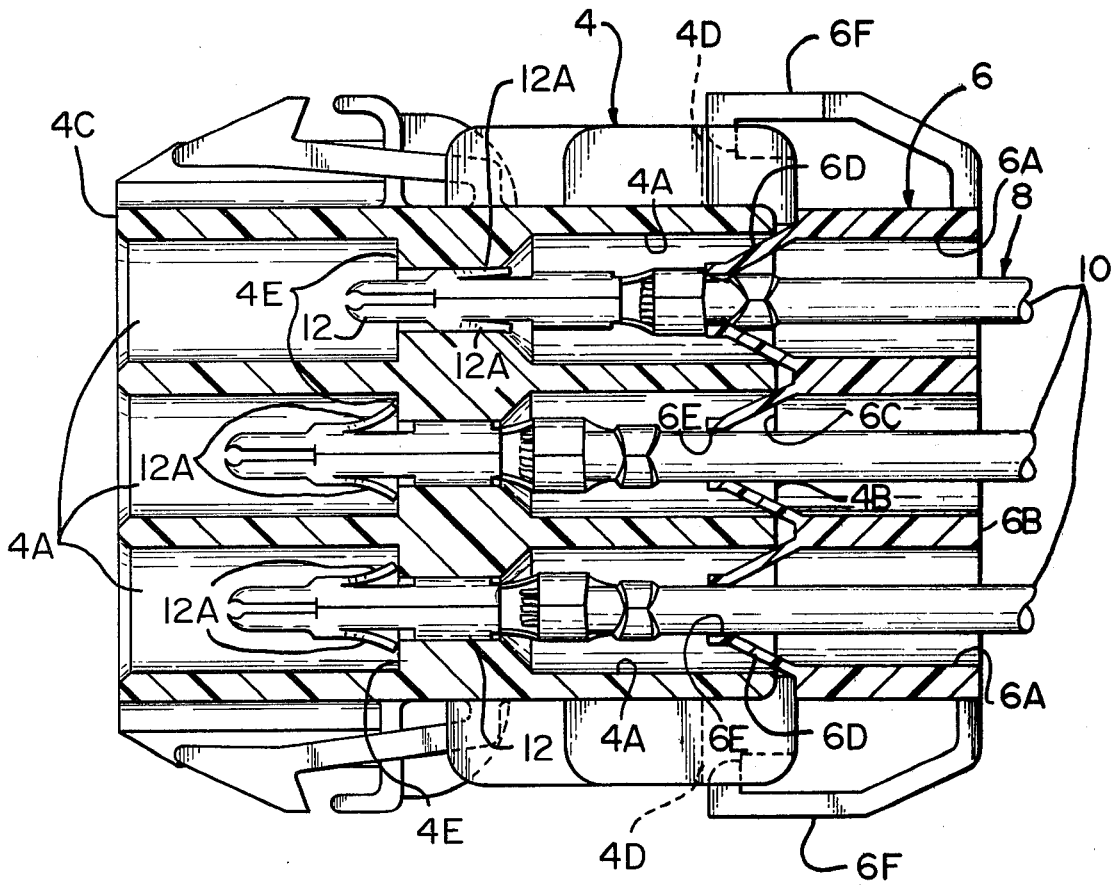
FIG. 3 is a fragmentary section view of the assembly shown in FIG. 2.

By way of reference to FIGS. 1, 2 and 3, the housing portion 4 includes a plurality of internal cavities 4A extending from a rearward end 4B to a forward, mating end 4C. Adjacent the rearward end 4B are latching detents 4D. The housing portion 4 advantageously is of single piece molded plastics construction. The retainer 6 also is of single piece, molded plastics construction, and includes a plurality of passageways 6A extending from a rearward end 6B to a forward end 6C. Means on the retainer 6 in the form of resiliently deflectable fingers 6D are distributed circumerentially of respective passageways 6A and converge in directions radially of the respective passageways 6A. The converging fingers 6D form restricted orifices 6E for the respective passageways 6A. Resiliently deflectable latching fingers 6F are molded to project in a forward direction. The retainer housing portion 6 is assembled on the rearward end 4B of the housing portion 4. The fingers 6D align with and project partially into the rearward ends of the cavities 4A. The fingers 6F interlock with the detents 4D to retain together the housing portions 4 and 6 to form the composite housing 2.

The subassemblies 8 are assembled with the composite housing 2 by a workman. First the workman inserts the contact 12 of a respective subassembly 8 into a respective passageway 6A of the rearward end 6B of the retainer 6. Further, the workman pushes the subassembly 8 along the passageway 6A, so that the contact 12 passes through the restricted orifice 6E and into registration within a cavity 4A of the housing portion 4. The fingers 6D spread apart or spring toward each other in response to passage of varied sectional dimensions of the subassembly. Accordingly, the orifice is expansible and contractible in response to passage thereinto of the respective subassembly 8. After the respective contact 12 passes entirely through the respective orifice 6E, the insulated conductor 10 extends along and through the orifice. The fingers 6D frictionally engage the insulated conductor 10. Proper registration of a respective subassembly 8 is achieved when the contact 12 thereof is inserted into a forward end of the respective cavity 4A and the wings 12A of the contact 12 spring outward radially. The wings 12A impinge against a radial shoulder 4E to secure the contact against withdrawal in a rearward direction.

Figure 4:
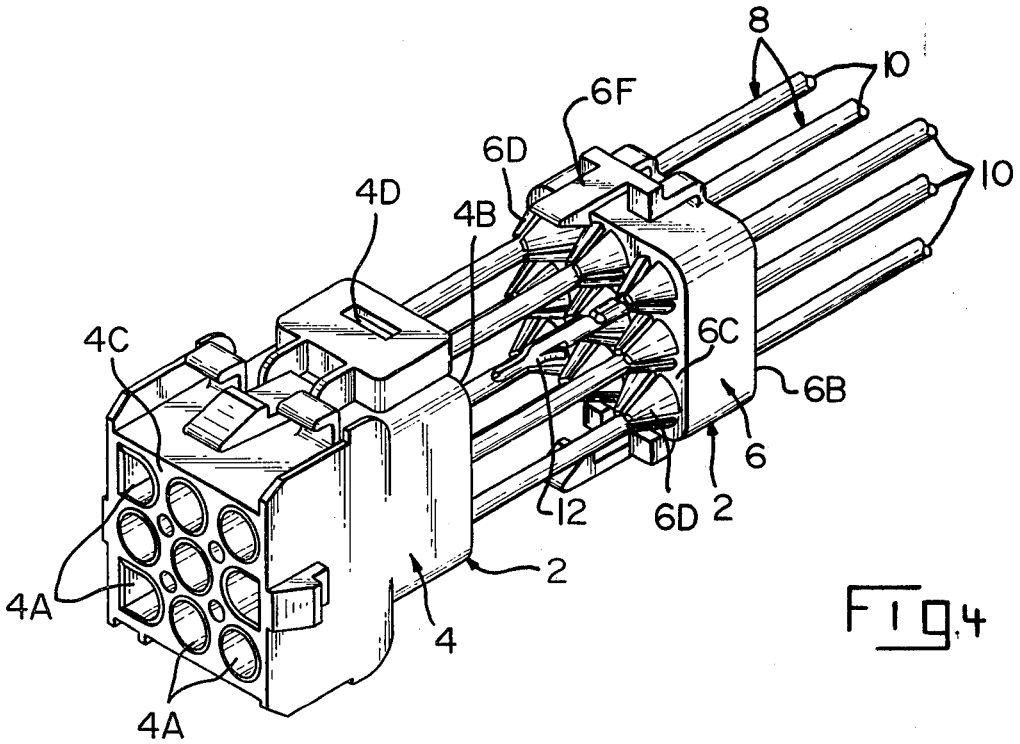
FIG. 4 is a fragmentary perspective view illustrating partial disassembly of the assembly shown in FIGS. 2 and 3.

The present invention provides a technique for discovering improper assembly of any subassembly 8 within the connector housing 2. After all subassemblies 8 are assembled into the composite connector housing 2, the workman unlatches and removes the retainer 6 from the housing portion 4. As shown in FIG. 4, the workman moves the retainer 6 in a rearward direction along the conductors 10 of the subassemblies 8. The fingers 6D, which frictionally engage radially against the conductors, will slide frictionally over those conductors 10 of the subassemblies 8 which are in proper registration to resist removal from the housing portion 4. As shown in FIG. 3, one of the subassemblies 8 is shown with the wings 12A failing to impinge against a respective shoulder 4E. This failing may be due to improper assembly with in the respective cavity 4A, or due to a damaged contact 12. Alternatively, the contact may be purposely designed, for example, with no wings 12A, not shown, so that the contact does not secure to the housing portion 4. As shown in FIG. 4, any contact 12 which is unsecured to the housing portion 4 is readily withdrawn therefrom by removal of the retainer 6 and movement thereof in rearward direction. For example, the respective fingers 6D, that frictionally engage the conductor 10, attached to the unsecured contact 12, will pull the conductor rearwardly to accompany movement of the retainer 6. The unsecured contact 12 becomes revealed upon its withdrawal from the housing portion 4. A workman then assembles properly the withdrawn subassembly 8 into the housing portion 4. Subsequently the assembly 1 is completed be the retainer 6 being moved along the conductors 10 and reassembled with the housing portion 4.

Other modifications and embodiments of the invention are intended to be covered by the spirit and scope of the present invention. For example, the resilient fingers 6D that frictionally engage the conductors 10 of the subassemblies 8 also may lodge against the rearward ends of the contacts 12 thereby to retain the contacts in the composite housing 2.

Although the invention described is only one form of connector assembly, other forms are intended to covered. For example, the housing 2 is of plug form adapted for mated connection with another housing of complementary receptacle form, shown in FIG. 1 at 14. The housing 14 is also of composite form. Housing portion 16 has cavities 16A extending from a rearward end 16B to a forward end 16C. The end 16C is of receptacle form for mated connection with the plug form mating end 4C of the housing 2. A retainer 18 is assembled with the housing portion 16. The retainer 18 and the retainer 4 may be identical to form interchangeable parts. Subassemblies 20 are assembled in the composite housing 14, and comprise elongated insulated conductors 22 connected with respective electrical contacts, not shown. These contacts are previously known and commerically available, electrical socket types adapted for mated connection with the plug type contacts 12 of the connector assembly 1.

I claim:

1. An electrical connector assembly, comprising a housing having a rearward end and a forward end constructed for mated connection with a complemenetary housing of another connector assembly, a plurality of cavities extending between the rearward and forward ends, a subassembly in each cavity comprising an elongate electrical conductor connected with an electrical contact, means being provided on the housing and contact to secure each subassembly in a respective cavity, the conductor of each subassembly projecting outwardly of the rearward end of the housing, a retainer adapted to be mounted in the rearward end of the housing, a plurality of passageways extending through the retainer, the conductors passing through respective passageways, engaging means on the retainer frictionally engaging respective conductors, said engaging means projecting from the retainer and into respective cavities of the housing while the retainer is mounted on the rearward end of the housing, and the retainer being removable from the housing in a rearward direction to withdraw from the housing any subassembly frictionally engaged by the means and that is unsecured for retention in a respective cavity of the housing.

2. The electrical connector assembly according to claim 1, characterised in that; the engaging means comprise a restricted orifice of each passageway, each orifice being expansible and contractible in response to passage thereinto of a respective subassembly.

3. The electrical connector assembly according to claim 1, characterised in that; the engaging means comprise a plurality of resiliently deflectable fingers distributed circumferentially of respective passageways and converging in directions radially of the respective passageways.

4. An electrical connector assembly for mated connection with another, complementary connector assembly, comprising:

a housing having a rearward end and a forward end constructed for mated connection with a complementary housing of another connector assembly;

a retainer adapted for mounting on the rearward end of the housing;

a plurality of passageways extending through said retainer;

engaging means on said retainer for frictionally engaging a respective subassembly comprised of an elongated electrical conductor connected with an electrical contact, and projecting from the retainer and into respective cavities of the housing while the retainer is mounted on the rearward end of the housing;

said housing having a plurality of cavities extending from said rearward end to said forward end;

each of said cavities being adapted for receiving therein a respective said contact of a respective said subassembly;

means being provided on the housing and contact to secure each subassembly in a respective cavity;

said retainer being removable from said housing in a rearward direction while frictionally engaged with each said subassembly, withdrawing from said housing any said subassembly that is unsecured for retention within a respective said cavity of said housing.

5. An electrical connector assembly as recited in claim 4, wherein, said engaging means comprise restricted orifices of said passageways expansible and contractible in response to passage therethrough of respective said subassemblies.

6. An electrical connector assembly as recited in claim 4, wherein, said engaging means comprise a plurality of resiliently deflectable fingers distributed circumferentially of respective said passageways and converging in directions radially of respective said passageways.

7. An electrical connector assembly as recited in claim 4, wherein, said engaging means lodge against rearward ends of respective said contacts of said subassemblies, and as said retainer is mounted on said rearward end of said housing, said means retain said contacts of said subassemblies from withdrawal outwardly of said housing in a rearward direction.

8. A kit of parts for an electrical connector assembly adapted for mated connection with another, complementary connector assembly, comprising:

a housing having a rearward end and a forward end constructed for mated connection with a complementary housing of another connector assembly;

a retainer adapted for mounting on the rearward end of the housing;

a plurality of passageways extending through said retainer;

engaging means on said retainer for frictionally engaging a subassembly, the subassembly comprising an elongated electrical conductor connected with an electrical contact, and projecting from the retainer and into respective cavities of the housing while the retainer is mounted on the rearward end of the housing;

said housing having a plurality of cavities extending from said rearward end to said forward end;

each of said cavities being adapted for receiving therein a respective said contact of a respective said subassembly, means being provided on the housing and contact to secure each subassembly in a respective cavity;

said retainer being removable from said housing in a rearward direction while frictionally engaged with each said subassembly. withdrawing from said housing any said subassembly that is unsecured within a respective said cavity of said housing.

9. The kit of parts as recited in claim 8, wherein, said engaging means comprise restricted orifices of said passageways expansible and contractible in response to passage therethrough of respective said subassemblies.

* * * * *